US008424712B2

(12) United States Patent
Cook et al.

(10) Patent No.: US 8,424,712 B2
(45) Date of Patent: Apr. 23, 2013

(54) CONTAINER SLEEVE

(75) Inventors: Matthew R. Cook, Hinsdale, IL (US); Kurt M. Wolf, Chicago, IL (US); Thomas Fu, Naperville, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 292 days.

(21) Appl. No.: 12/748,037

(22) Filed: Mar. 26, 2010

(65) Prior Publication Data

US 2011/0233224 A1 Sep. 29, 2011

(51) Int. Cl.
*B65D 25/14* (2006.01)

(52) U.S. Cl.
USPC ..... 220/738; 220/737

(58) Field of Classification Search ..... 220/62.22, 220/62.12, 592.2, 592.26, 737, 738, 739; 229/402, 403
See application file for complete search history.

(56) References Cited

U.S. PATENT DOCUMENTS

| | | | | | |
|---|---|---|---|---|---|
| 2,226,349 | A | * | 12/1940 | Royle | 428/19 |
| 2,810,977 | A | * | 10/1957 | Barry | 428/4 |
| 3,126,139 | A | | 3/1964 | Schechter | |
| 5,203,490 | A | | 4/1993 | Roe | |
| 5,524,814 | A | * | 6/1996 | Davis | 229/117.08 |
| 5,609,928 | A | * | 3/1997 | Yedlin et al. | 428/5 |
| D383,947 | S | | 9/1997 | Schaefer | |
| 5,667,135 | A | | 9/1997 | Schaefer | |
| 5,769,311 | A | * | 6/1998 | Morita et al. | 229/403 |
| 5,775,570 | A | * | 7/1998 | Kim | 229/4.5 |
| 6,032,826 | A | | 3/2000 | Libit | |
| 6,053,352 | A | | 4/2000 | Cai | |
| 6,273,333 | B1 | | 8/2001 | Ward | |
| 6,343,735 | B1 | | 2/2002 | Cai | |
| 6,439,452 | B1 | * | 8/2002 | Tsao | 229/120.15 |
| 6,926,197 | B2 | * | 8/2005 | Hed et al. | 229/403 |
| 7,121,991 | B2 | * | 10/2006 | Mannlein et al. | 493/109 |
| 7,264,134 | B2 | | 9/2007 | Tulp | |
| D585,700 | S | | 2/2009 | Chu | |
| 2006/0000882 | A1 | | 1/2006 | Darzinskas | |
| 2007/0215618 | A1 | * | 9/2007 | Wright et al. | 220/62.12 |
| 2009/0114661 | A1 | * | 5/2009 | Lim | 220/737 |
| 2009/0272753 | A1 | * | 11/2009 | Rebelak et al. | 220/737 |
| 2010/0200603 | A1 | * | 8/2010 | Kim et al. | 220/739 |
| 2010/0224637 | A1 | * | 9/2010 | Ikeda et al. | 220/592.2 |

* cited by examiner

*Primary Examiner* — David Fidei
(74) *Attorney, Agent, or Firm* — Brinks Hofer Gilson & Lione

(57) ABSTRACT

A container sleeve includes a sheet of material that defines a first edge member and a second edge member. The container sleeve defines an upper cross member with a first end connected to the first edge member and a second end connected to the second edge member, and a lower cross member with a first end connected to the first edge member and a second end connected to the second edge member. The container sleeve further defines a center cross member positioned between the upper cross member and the lower cross member. The center cross member includes a first end connected to the first edge member and a second end connected to the second edge member. A center region of the cross member is configured to be positioned away from a center region of the upper cross member and a center region of the lower cross member to enable the insertion of a container into an opening defined between the upper cross member, the lower cross member, and the center cross member.

9 Claims, 3 Drawing Sheets

CONTAINER SLEEVE

FIELD

The present application relates to a sleeve for a container that insulates a user's hand from heat produced in the container.

DESCRIPTION OF RELATED ART

Container sleeves are utilized to provide protection from heat produced by a hot liquid in a container, such as a cup. A typical container sleeve comprises a sheet of material in which opposing ends are attached together. The opposing ends may be glued or otherwise fastened to each other. To provide for compactness, the sheet may be pressed into a generally flat configuration. To utilize the container sleeve, a user pinches the opposing ends of the flattened sleeve towards each other. This causes the flattened sheets to separate from one another and form an opening for receiving the container. Once separated, the user inserts the container into the opening.

BRIEF SUMMARY

A container sleeve includes a sheet of material that defines a first edge member and a second edge member. The container sleeve defines an upper cross member with a first end connected to the first edge and a second end connected to the second edge, and a lower cross member with a first end connected to the first edge and a second end connected to the second edge. The container sleeve further defines a center cross member positioned between the upper cross member and the lower cross member. The center cross member includes a first end connected to the first edge and a second end connected to the second edge.

In an unassembled configuration, the upper cross member, lower cross member, and center cross member define a substantially planar surface that enables stacking a group of sleeves.

In an operational configuration, a center region of the cross member is configured to be positioned away from a center region of the upper cross member and a center region of the lower cross member to enable the insertion of a container into an opening defined between the upper cross member, the lower cross member, and the center cross member.

Other systems, methods, features and advantages of the invention will be, or will become, apparent to one with skill in the art upon examination of the following figures and detailed description. It is intended that all such additional systems, methods, features and advantages be included within this description, be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described of the invention serve to explain the principles defined by the claims.

DETAILED DESCRIPTION OF THE DRAWINGS

The exemplary embodiments below describe various embodiments of container sleeves that comprise a single sheet of material that is cut and creased in various locations to enable a container to be inserted into the sleeves. The sleeves are in the form of a planar sheet of material in an unassembled configuration. Various members of the sleeve are configured to be separated or moved apart to provide an opening for inserting a container. For the sake of convenience, the sleeve is described with a cup.

Figure 1A:
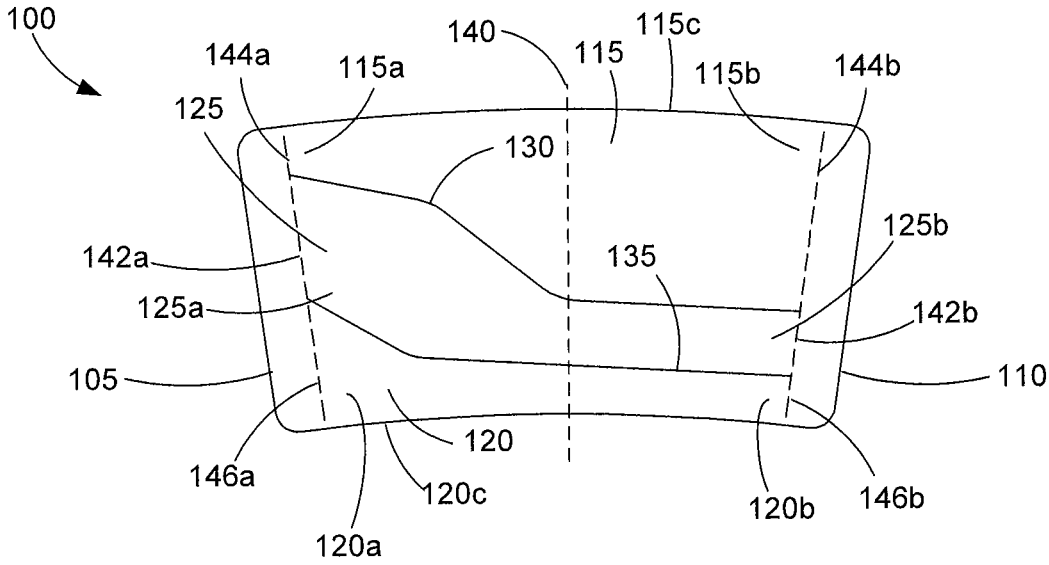
FIG. 1 illustrates a container sleeve in an unassembled configuration.
FIG. 1B illustrates a perspective view the container sleeve of FIG. 1 in an open configuration with a cup inserted into the a container sleeve.
Figure 1B:
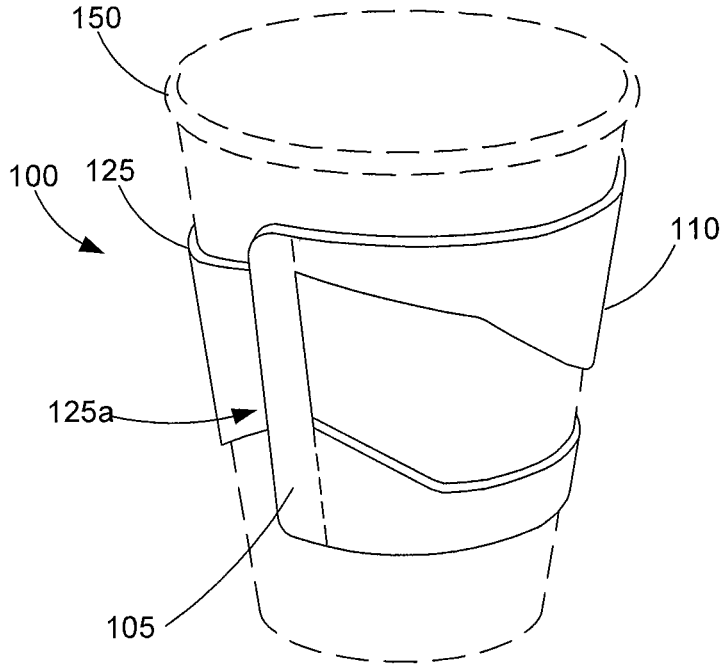

FIG. 1A illustrates a container sleeve 100 in an unassembled configuration. The container sleeve 100 is hereinafter referred to as the sleeve 100. In some embodiments, the sleeve 100 is made of a single sheet of material that defines a first edge member 105, a second edge member 110, an upper cross member 115, a lower cross member 120, and a center cross member 125. In other embodiments, multiple sheets of material may be "sandwiched" together to increase the stiffness of the sleeve 100.

The upper cross member 115 substantially defines an upper edge 115*c* of the sleeve 100. The upper cross member 115 includes a first end 115*a* and a second end 115*b*. The first end 115*a* is connected to the first edge member 105. The second end 115*b* is connected to the second edge member 110.

The lower cross member 120 defines a lower edge member 120*c* of the sleeve 100. The lower cross member 120 includes a first end 120*a* and a second end 120*b*. The first end 115*a* is connected to the first edge member 105. The second end 120*b* is connected to the second edge member 110.

The center cross member 125 is positioned between the upper cross member 115 and the lower cross member 120. The center cross member 125 includes a first end 125*a* and a second end 125*b*. The first end 125*a* is connected to the first edge member 105 and the second end 125*b* is connected to the second edge member 110. A first cut edge 130 separates the center cross member 125 from the upper cross member 115. A second cut edge 135 separates the center cross member 125 from the lower cross member 120.

In the unassembled configuration, the first edge member 105, the second edge member 110, the upper cross member 115, the lower cross member 120, and the center cross member 125 define a substantially planar surface. The first cut edge 130 and the second cut edge 135 enable the center cross member 125 to be positioned away from both the upper cross member 115 and the lower cross member 120 along a centerline 140 of the sleeve 100. This in turn forms an opening in the sleeve 100 that enables the insertion of a container 150, such as a tapered cup.

In some embodiments, the upper edge 115*c* and the lower edge 120*c* of the sleeve are shaped in the form of an arc, as shown. The first edge member 105 and the second edge member 110 may taper towards each other. The radius of the respective edges 115*c* and 120*c* and the amount by which the edges are tapered may be sized so that the upper cross member 115, the lower cross member 120, and the center cross member 125 follow the contour of a tapered container, such as a tapered cup, when the container is inserted into the sleeve 100.

In some embodiments, a first creased edge 142*a* is provided between the first end 125*a* of the center cross member 125 and the first edge member 105, and a second creased edge

142*b* is provided between the second end 125*b* of the center cross member 125 and the second edge member 110. The first creased edge 142*a* and the second crease edge 142*b* enable the first end 125*a* and the second end 125*b* of the center cross member 125 to be folded over the first edge 105 and the second edge 110, respectively. In other embodiments, creases 144*a*, 144*b*, 146*a*, and 146*b* may be provided between the first ends 115*a* and 120*a* and the second ends 115*b* and 120*b* of the upper cross member 115 and/or the lower cross member 120 and the first edge member 105 and the second edge member 110, respectively. The respective creases 144*a*, 144*b*, 146*a*, and 146*b* enable folding the first ends 115*a* and 120*a* and second ends 115*b* and 120*b* of the upper cross member 115 and/or the lower cross member 120 over the first edge member 105 and the second edge member 110, respectively.

Figure 2A:
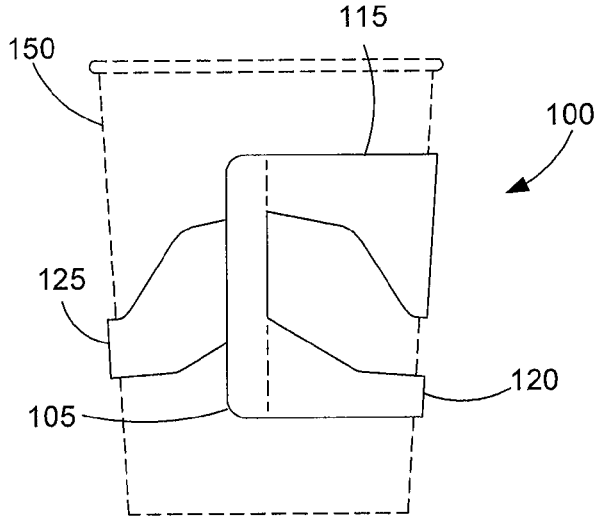
FIGS. 2A-2C illustrate left side, front, and right side views, respectively, of the cup and container sleeve.
Figure 2B:
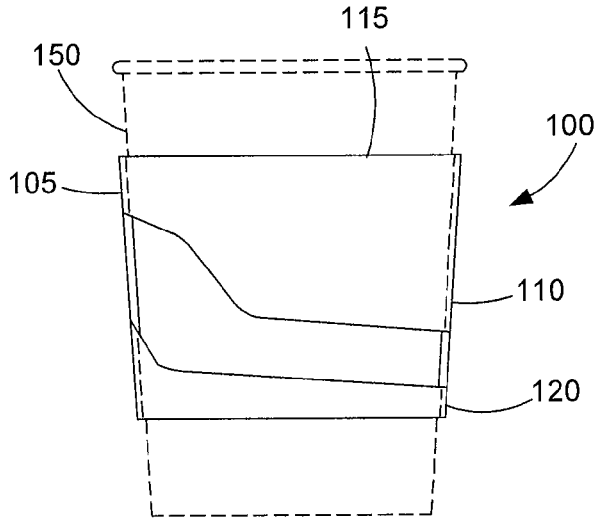
Figure 2C:
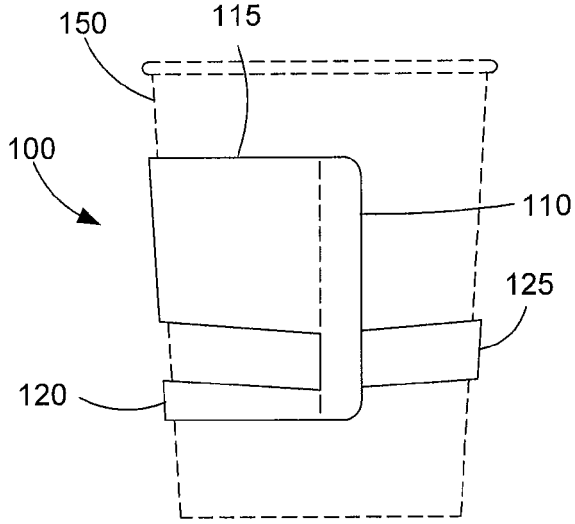

FIGS. 1B-2C illustrate the sleeve 100 in an open configuration. In the open configuration, the center cross member 125 is positioned away from both the upper cross member 115 and the lower cross member 120 to define an opening for receiving a container 150, such as the tapered cup shown in FIG. 1B. The first end 125*a* of the center cross member 125 is folded behind the first edge 105 of the sleeve 100, as shown. The second end 125*b* of the center cross member 125 may be folded behind the second edge 110 of the sleeve 100, as shown in FIG. 2C.

As shown, the upper cross member 115, lower cross member 120, and center cross member 125 may be sized to insulate a user's fingers from heat produced within the container. For example, the center cross member 125 may be sized to insulate the user's thumb. The upper cross member 115 and the lower cross member 120 may be sized to insulate the user's other fingers. To improve the insulation characteristics, the sleeve 100 may comprises a corrugated paper material, which may act as an insulating material.

Figure 3:
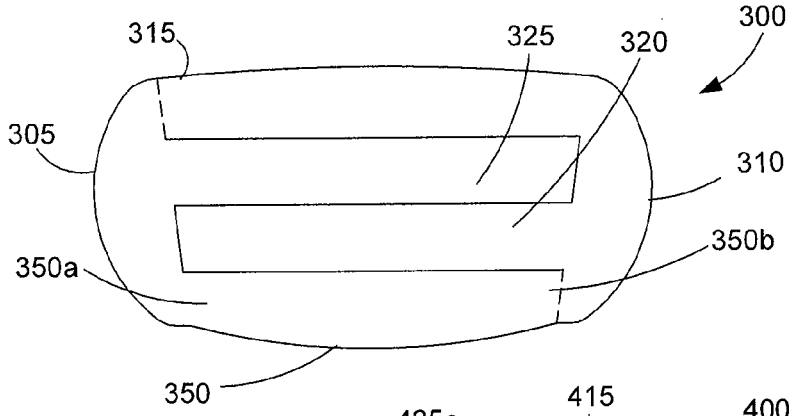
FIGS. 3-6 illustrate second, third, fourth, and fifth embodiments, respectively, of a container sleeve.

While various embodiments have been described, it will be apparent to those of ordinary skill in the art that many more embodiments and implementations are possible that are within the scope of the claims. For example, as shown in FIG. 3, in a different embodiment a sleeve 300 may include an upper cross member 315, a center cross member 325, and a lower cross member 320, as described above, and also a fourth cross member 350 positioned below the lower cross member 320. A first end 350*a* of the fourth cross member 350*b* may be connected to a first edge member 305 of the sleeve 300, and a second end 350*b* of the fourth cross member 350 may be connected to a second edge member 310 of the sleeve 300. In an open configuration, center regions of the center cross member 325 and the fourth cross member 350 may be positioned away from the upper cross member 315 and the lower cross member 320 to enable inserting a container into the sleeve 300, as described above.

Figure 4:
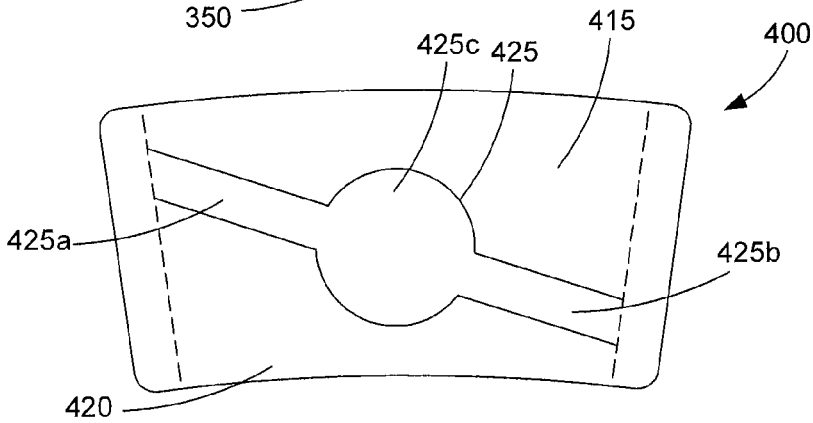
Figure 5:
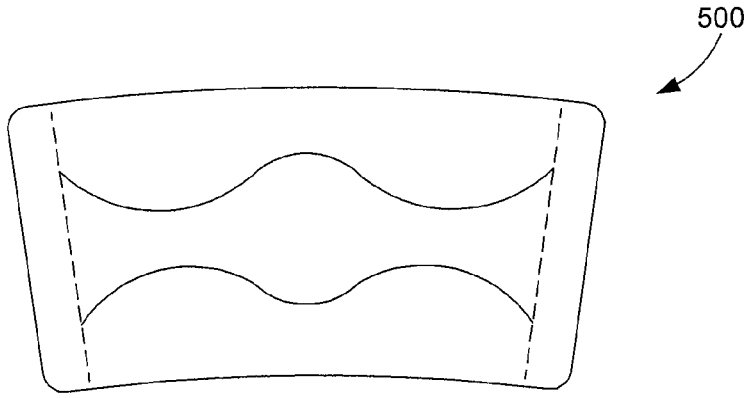

The sleeve may be modified in yet other manners. For example, as shown in FIG. 4, the center cross member 425 of the sleeve 400 may extend diagonally across the sleeve 400, as shown. The center cross member 425 may include a center portion 425*c* sized to insulate a user's thumb and a pair of extensions 425*a* and 425*b*. The extensions 425*a* and 425*b* may be thinner than the center portion 425*c* to minimize the amount of material utilized by the center cross member 425. This in turn results in a corresponding increase in the surface area of the upper cross member 415 and lower cross member 420, respectively, which provides for a larger insulating surface for the user.

Figure 6:
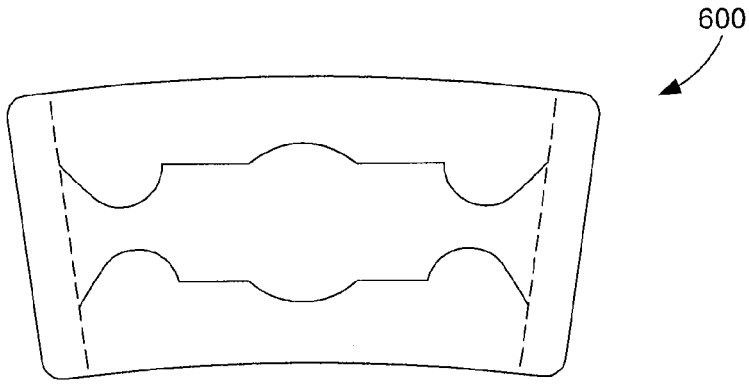

FIGS. 6 and 7 show yet other implementations of sleeves 500 and 600 that fall within the scope of the claims. Accordingly, it will be apparent to those of ordinary skill in the art that many more embodiments and implementations are possible that are within the scope of the claims. Therefore, the embodiments described are only provided to aid in understanding the claims and do not limit the scope of the claims.

The invention claimed is:

1. A container sleeve comprising:

a sheet of material that defines:

a first edge member and a second edge member;

an upper cross member with a first end connected to the first edge member and a second end connected to the second edge member;

a lower cross member with a first end connected to the first edge member and a second end connected to the second edge member;

a center cross member positioned between the upper cross member and the lower cross member, the center cross member includes a first end connected to the first edge member and a second end connected to the second edge member, wherein in an unassembled configuration the upper cross member, the lower cross member, and the center cross member define a substantially planar surface, and wherein a center region of the cross member is separable from a center region of the upper cross member and a center region of the lower cross member to define a generally circular opening between the upper cross member, the lower cross member, and the center cross member that facilitates the insertion of a generally cylindrical container therein, wherein the upper, lower, and center, cross members curve to provide substantially constant contact with an outer surface the container when inserted, and wherein at least a portion of the center member that is connected to the first edge member is folded behind the first edge member such that the portion is positioned between the first edge member and the outer surface of the container when inserted to substantially eliminate any gap between first edge member and the container.

2. The container sleeve according to claim 1, wherein the center cross member and the upper cross member are separated by a first cut edge and the center cross member and the lower cross member are separated by a second cut edge.

3. The container sleeve according to claim 1, wherein the generally circular opening is tapered to match a tapered outside surface of a tapered container.

4. The container sleeve according to claim 1, wherein respective widths and heights of the upper cross member, the lower cross member, and the center cross member are sized so that one or more fingers of a user are insulated from heat produced within the container by at least one of the upper and the lower cross members and that one or more opposing fingers of the user are insulated from heat produced within the container by the center cross member.

5. The container sleeve according to claim 1, wherein the planar sheet of material comprises a corrugated paper material.

6. The container sleeve according to claim 1, further comprising a fourth cross member positioned below the lower cross member with a first end connected to the first edge member and a second end connected to the second edge member.

7. The container sleeve according to claim 1, further comprising a first crease between the first end of the center cross member and the first edge member and a second crease between the second end of the center cross member and the second edge member, wherein the first crease enables folding the first end of the center cross member over the first edge member and the second crease enables folding the second end of the center cross member over the second edge member.

8. The container sleeve according to claim 1, further comprising a first crease between the upper cross member and the first edge member and a second crease between the upper cross member and the second edge member, and a third crease between the lower cross member and the first edge member and a fourth crease between the lower cross member and the second edge member, wherein the first crease and the third crease enable folding the first end of the upper cross member and the first end of the lower cross member over the first edge member and the second crease and the fourth crease enable folding the second end of the upper cross member and the second end of the lower cross member over the second edge member.

9. The container sleeve according to claim 1, wherein the center cross member comprises a center portion sized to accommodate a user's thumb.

* * * * *